US006499940B2

(12) United States Patent
Adams

(10) Patent No.: US 6,499,940 B2
(45) Date of Patent: Dec. 31, 2002

(54) COMPRESSOR CASING FOR A GAS TURBINE ENGINE

(75) Inventor: Paul R. Adams, Glastonbury, CT (US)

(73) Assignee: Williams International Co., L.L.C., Walled Lake, MI (US)

( * ) Notice: Subject to any disclaimer, the term of this patent is extended or adjusted under 35 U.S.C. 154(b) by 0 days.

(21) Appl. No.: 09/812,001

(22) Filed: Mar. 19, 2001

(65) Prior Publication Data

US 2002/0131858 A1 Sep. 19, 2002

(51) Int. Cl.[7] ..... F01D 21/00

(52) U.S. Cl. ..... 415/9; 415/121.2; 415/169.1; 415/173.1; 415/914

(58) Field of Search ..... 415/9, 200, 173.1, 415/173.4, 173.5, 914, 121.2, 169.1

(56) References Cited

U.S. PATENT DOCUMENTS

| | | | | | |
|---|---|---|---|---|---|
| 4,466,772 | A | * | 8/1984 | Okapuu et al. | 415/173.5 |
| 4,738,586 | A | * | 4/1988 | Harter | 415/173.5 |
| 4,767,266 | A | * | 8/1988 | Holz et al. | 415/173.5 |
| 5,707,206 | A | * | 1/1998 | Goto et al. | 415/173.1 |
| 6,350,102 | B1 | * | 2/2002 | Bailey et al. | 415/173.5 |

* cited by examiner

*Primary Examiner*—Christopher Verdier
(74) *Attorney, Agent, or Firm*—Dinnin & Dunn P.C.

(57) ABSTRACT

The cylindrical compressor casing of a gas turbine engine has a plurality of radially inwardly and axially rearwardly opening anti-surge grooves disposed on a radially inner surface thereof whereby foreign objects ingested into the engine and entering the grooves are free to move axially rearwardly of the engine.

2 Claims, 2 Drawing Sheets

COMPRESSOR CASING FOR A GAS TURBINE ENGINE

BACKGROUND OF THE INVENTION

This invention relates generally to gas turbine engines and more particularly to an improved compressor casing for a gas turbine engine that minimizes the deleterious effect of foreign object ingestion into the engine without compromising surge margin of the engine, thereby to enhance its utility as the power plant of an aircraft.

A typical gas turbine engine comprises a compressor, a combustor and a turbine in fluid flow relation. A variant of the typical engine includes a fan disposed forwardly of the compressor and an annular by-pass duct that surrounds the compressor.

One requirement of a jet engine in the aircraft environment is that it be capable of ingesting foreign objects without catastrophic damage. The problem of foreign object ingestion has been solved in the past by merely increasing the strength of the engine components exposed to impact damage. However, strength is generally equated with weight, which, in turn, compromises performance of the aircraft. Reconciliation of such seemingly divergent performance and safety requirements requires careful design of the aircraft's propulsion system coupled with airframe aerodynamics.

Another factor that must be considered when addressing the problem of foreign object ingestion, is preservation of the surge margin of the fan and/or compressor stages. Radially grooved compressor casings have been used heretofore on gas turbine fan and compressor stages to enhance their surge margin. Unfortunately, such heretofore-known radially grooved casings have increased fan and compressor stage susceptibility to foreign object damage. Specifically, since the radial component of velocity imparted to foreign objects by the fan or compressor blades is greater than the axial velocity thereof, radially extending casing grooves capture and entrap the debris, potentially causing catastrophic damage to the engine. Thus, there is a need for an improved casing for the fan or compressor of a gas turbine engine that minimizes entrapment of ingested debris while still offering fan and/or compressor surge margin during normal operation.

SUMMARY OF THE INVENTION

The present invention solves the aforesaid problem by utilizing a plurality of radially inwardly and axially rearwardly opening circumferential grooves in the compressor casing. The grooves are disposed slightly downstream of a line swept by the leading edge of the fan or compressor blade tip. The inclined grooves offer reduced target and entrapment area for debris. Axially spaced, circumferential fins defining the grooves are sufficiently deformable so as to close upon initial impact by debris, thus minimizing the opportunity for debris entrapment. The casing grooves are preferably used in conjunction with backswept fan or compressor blades and provide fan or compressor surge margin in the conventional manner.

DETAILED DESCRIPTION OF THE PREFERRED EMBODIMENT

Figure 1:
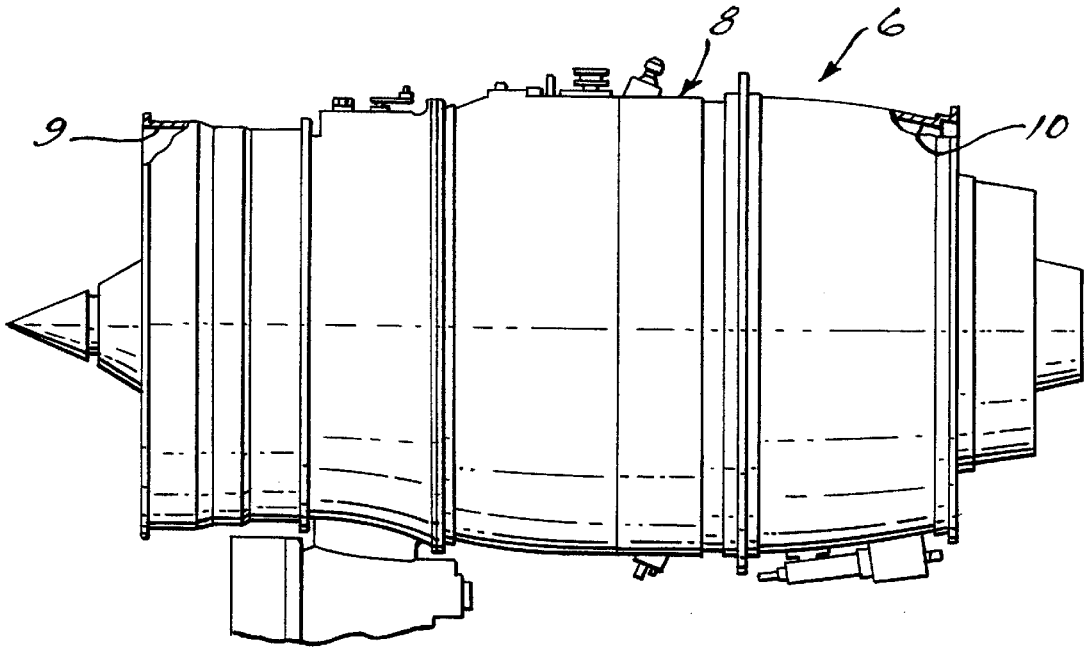
FIG. 1 is an elevational view of a turbofan engine provided with a fan or compressor casing in accordance with the present invention.

As seen in FIG. 1, a typical environment in which the present invention has utility comprises a by-pass turbofan engine 6 having a cylindrical casing 8 defining an air intake 9 at the front thereof and an annular by-pass duct 10 extending to the rear thereof.

Figure 2:
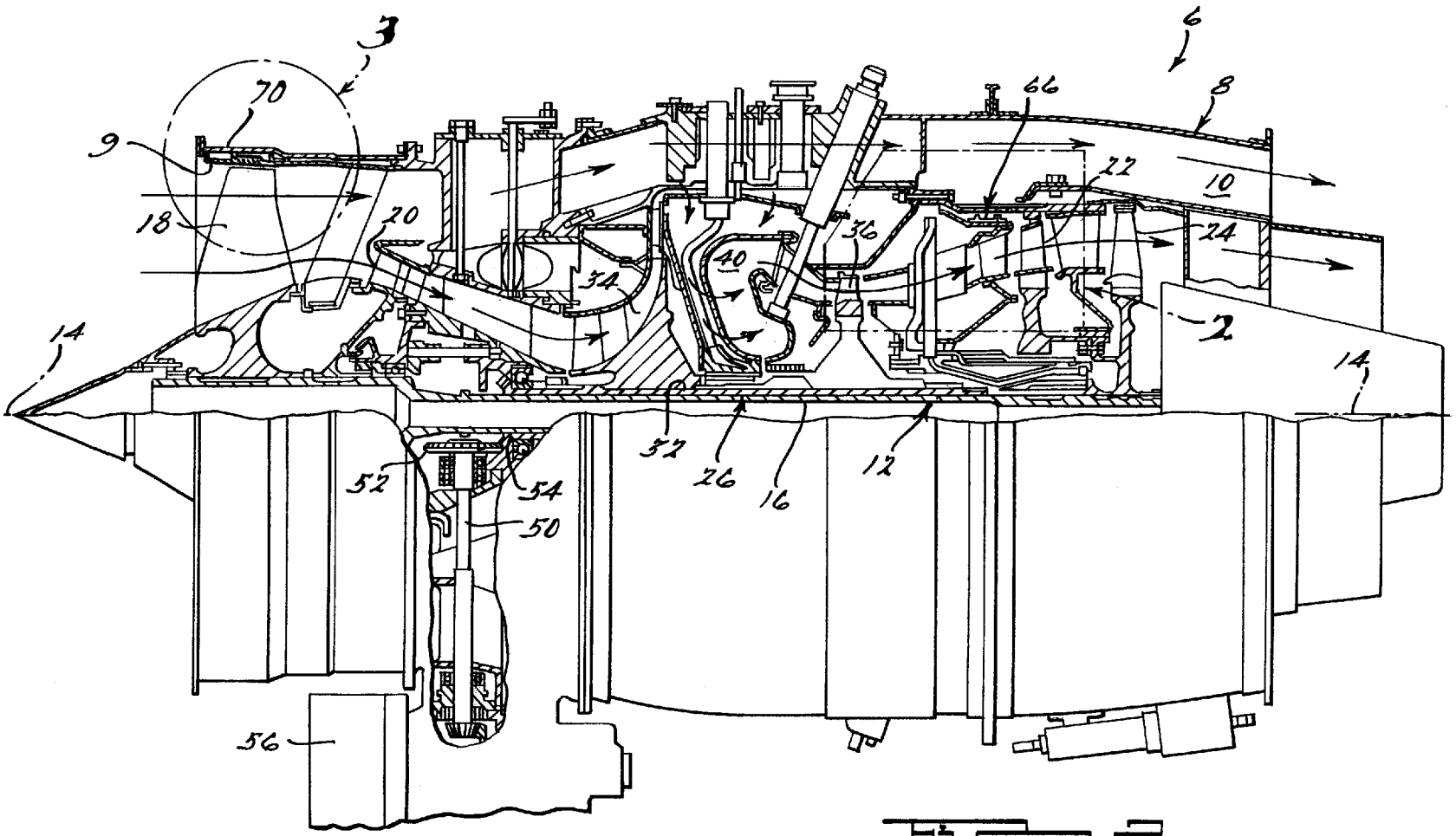
FIG. 2 is a view of the engine of FIG. 1 partially in cross section.

As seen in FIG. 2, a low pressure spool assembly 12, is rotatable about a central longitudinal axis 14 of the engine 6 and comprises a shaft 16 having a fan 18 and an intermediate pressure compressor stage 20 at the forward end thereof. An intermediate pressure turbine 22 and a low-pressure turbine 24 are disposed on the aft end of the shaft 16.

A high pressure spool assembly 26 is telescoped over the low pressure spool 12 in coaxial relation thereto and comprises a shaft 32 having a high pressure compressor 34 at a forward end thereof and a high pressure turbine 36 at the aft end thereof.

An annular combustor 40 is disposed about the low and high-pressure spools 12 and 26, respectively, between the high-pressure compressor 34 and high-pressure turbine 36.

The flow of air induced by the fan 18 of the engine 6 is split, combustion air flowing to the low-pressure compressor 20 and by-pass air flowing to the by-pass duct 10. Combustion air flows from the low-pressure compressor 20 to the high-pressure compressor 34, thence to the combustor 40 wherein fuel is introduced and burned. Combustion gases pass through the high-pressure turbine 36, thence through the intermediate and low pressure turbines 22 and 24, respectively.

By pass air flows from the fan 18 through the by-pass duct 10 without additional heat energy being imparted thereto. However, because of the relatively high mass flow of air induced by the fan 18, significant thrust is produced thereby.

Figure 3:
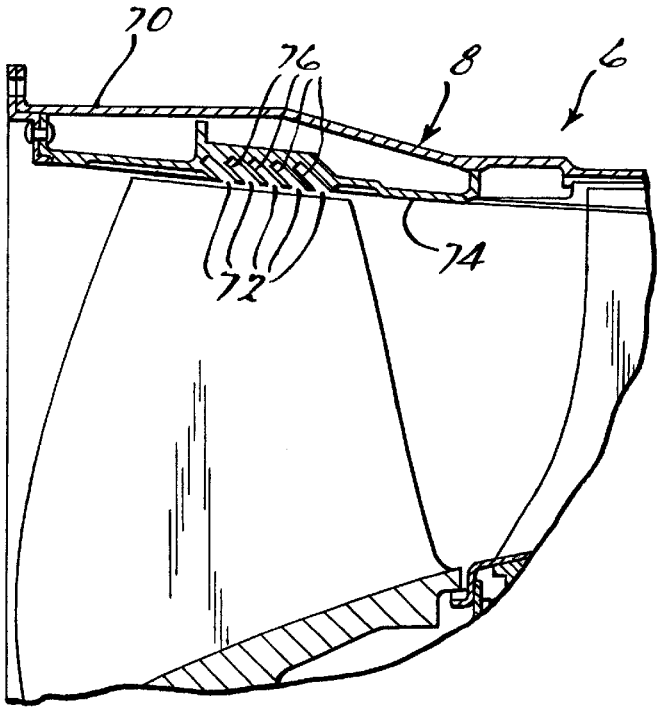
FIG. 3 is an enlarged view taken within the circle "3" of FIG. 2.

In accordance with the present invention, and as best seen in FIG. 3, a forward end 70 of the engine casing 8 is provided with a plurality of radially inwardly and axially rearwardly opening annular grooves 72 on a radially inner surface 74 thereof. The grooves 72 are defined by fins 76 which extend radially inwardly and axially rearwardly from the casing 8. Because the grooves 72 open rearwardly of the casing 8, the axially rearward inertia component of a foreign object ingested into the engine 6 is utilized to clear the grooves 72. Moreover, impact of a relatively heavy object against the radially inner edges of the fins 76 tends to bend the fins 76 radially outwardly and rearwardly so as to close the grooves 72 therebetween.

From the foregoing it should be apparent that entrapment of debris and resultant collateral damage caused by ingestion of a foreign object into a gas turbine engine 6 having a casing 8 in accordance with the present invention, is minimized. Moreover, the disclosed radially grooved casing 8 decreases the engine's susceptibility to foreign object damage while maintaining necessary surge margin.

While the preferred embodiment of the invention has been disclosed, it should be appreciated that the invention is susceptible of modification without departing from the scope of the following claims.

I claim:

1. In a gas turbine engine comprising a compressor having a radially extending array of blades exposed to the ingestion of foreign objects, the improvement comprising:

a generally cylindrical casing disposed radially outwardly of the blades of said compressor; and a plurality of circumferentially extending, axially spaced, radially inwardly and axially rearwardly extending laminar fins defining a plurality of radially inwardly and axially rearwardly opening continuous anti-surge grooves disposed on a radially inner surface of said casing in radially aligned relation to said compressor blades wherein said grooves remain clear during normal operation of the engine and whereby foreign objects ingested into said engine and impacting said grooves, are free to move axially rearwardly of said grooves.

2. The gas turbine engine of claim 1 wherein the radially inwardly and axially rearwardly extending fins on said casing are bendable rearwardly of said engine upon impact by a foreign object so as to close said grooves.

* * * * *